US007163645B2

(12) United States Patent
Hanada et al.

(10) Patent No.: US 7,163,645 B2
(45) Date of Patent: Jan. 16, 2007

(54) SOLVENT COMPOSITION

(75) Inventors: Tsuyoshi Hanada, Chiba (JP); Masaaki Tsuzaki, Chiba (JP)

(73) Assignee: Asahi Glass Company, Limited, Tokyo (JP)

( * ) Notice: Subject to any disclaimer, the term of this patent is extended or adjusted under 35 U.S.C. 154(b) by 96 days.

(21) Appl. No.: 11/026,092

(22) Filed: Jan. 3, 2005

(65) Prior Publication Data

US 2005/0109988 A1 May 26, 2005

Related U.S. Application Data

(63) Continuation of application No. PCT/JP03/08497, filed on Jul. 3, 2003.

(30) Foreign Application Priority Data

Jul. 3, 2002 (JP) ..... 2002-194888

(51) Int. Cl.
*C23G 5/028* (2006.01)
*C23G 5/032* (2006.01)
*C11D 7/30* (2006.01)

(52) U.S. Cl. ..... 252/364; 510/165; 510/166; 510/175; 510/176; 510/177; 510/408; 510/410; 510/411; 510/412; 510/415; 134/40

(58) Field of Classification Search ..... None
See application file for complete search history.

(56) References Cited

U.S. PATENT DOCUMENTS 3,539,462 A * 11/1970 Schofield ..... 510/410
4,877,545 A * 10/1989 Merchant et al. ..... 510/177
4,936,923 A * 6/1990 Merchant et al. ..... 510/177
4,999,127 A * 3/1991 Merchant ..... 252/67
5,087,383 A * 2/1992 Robeck et al. ..... 510/109
5,126,067 A * 6/1992 Swan et al. ..... 510/408
6,030,934 A * 2/2000 Owens et al. ..... 510/411
6,281,185 B1 8/2001 Owens et al.
6,395,699 B1 * 5/2002 Kitamura et al. ..... 510/410
2003/0228997 A1 * 12/2003 Doyel et al. ..... 510/410

FOREIGN PATENT DOCUMENTS

| | | | |
|---|---|---|---|
| JP | 4-227695 | | 8/1992 |
| JP | 6-57296 | | 3/1994 |
| JP | 10-324652 | | 12/1998 |
| JP | 10-324897 | | 12/1998 |
| JP | 2000-501777 | | 2/2000 |
| WO | WO 00/17301 | * | 3/2000 |

* cited by examiner

*Primary Examiner*—Joseph D. Anthony
(74) *Attorney, Agent, or Firm*—Oblon, Spivak, McClelland, Maier & Neustadt, P.C.

(57) ABSTRACT

A solvent composition comprising 1,1,2,2-tetrafluoroethyl-2,2,2-trifluoroethyl ether in an amount of from 25.0 to 75.0% (by mass, and the same applies hereinafter), trans-1,2-dichloroethylene in an amount of from 15.0 to 74.9%, and a $C_{1-3}$ alcohol in an amount of from 0.1 to 10.0%, to the total amount of the 1,1,2,2-tetrafluoroethyl-2,2,2-trifluoroethyl ether, the trans-1,2-dichloroethylene and the $C_{1-3}$ alcohol. The solvent composition of the present invention can remove soil such as flux with a high cleaning performance.

14 Claims, No Drawings

SOLVENT COMPOSITION

TECHNICAL FIELD

The present invention relates to solvent compositions to be used for removing oils and greases attached to articles such as electronic components such as IC, precision mechanical components, glass substrates, etc., or soil such as flux or dust on printed boards.

BACKGROUND ART

Heretofore, in the precision mechanical industry, the optical instrument industry, the electrical and electronics industry or the plastics industry, for precision cleaning to remove oil, flux, dust, wax or the like attached during manufacturing processes, a hydrochlorofluorocarbon (hereinafter referred to as HCFC) such as dichloropentafluoropropane (hereinafter referred to as R-225) has been widely employed as a fluorinated solvent which is nonflammable and excellent in chemical and heat stability and which is capable of dissolving oils and greases.

However, there is a problem that HCFC has an ozone depleting potential, and its production is expected to be abolished in advanced countries by year of 2020. Whereas, 1,1,2,2-tetrafluoroethyl-2,2,2-trifluoroethyl ether ($CHF_2CF_2OCH_2CF_3$) is a fluorinated solvent which has no ozone depleting potential and which presents little impact to the global environment, but it has a problem that its solvency for oils and greases is low. On the other hand, trans-1,2-dichloroethylene has a high solvency for oils and greases, but it has a problem that its flash point is as low as 4° C.

Further, an azeotrope of 1,1,2,2-tetrafluoroethyl-2,2,2-trifluoroethyl ether and trans-1,2-dichloroethylene is known (see claim 3 of JP-A-10-324652). The above mixture is nonflammable and has an excellent cleaning performance, but it has a problem such that e.g. in defluxing, removal of ionic soil tends to be inadequate, or white residues tend to remain.

DISCLOSURE OF THE INVENTION

The present invention provides a solvent composition comprising 1,1,2,2-tetrafluoroethyl-2,2,2-trifluoroethyl ether (R347), trans-1,2-dichloroethylene (tDCE) and a $C_{1-3}$ alcohol (ROH), wherein the content of (R347) is from 25.0 to 75.0% (by mass, and hereinafter, contents are all expressed by mass), the content of (tDCE) is from 15.0 to 74.9% and the content of (ROH) is from 0.1 to 10.0%, to the total amount of (R347), (tDCE) and (ROH) (hereinafter referred to as composition A).

The present invention provides a solvent composition comprising 1,1,2,2-tetrafluoroethyl-2,2,2-trifluoroethyl ether (R347), trans-1,2-dichloroethylene (tDCE) and methanol (MeOH), wherein the content of (R347) is from 35.0 to 55.0%, the content of (tDCE) is from 39.0 to 61.0% and the content of (MeOH) is from 4.0 to 6.0%, to the total amount of (R347), (tDCE) and (MeOH) (hereinafter referred to as composition B).

The present invention provides a solvent composition comprising 1,1,2,2-tetrafluoroethyl-2,2,2-trifluoroethyl ether (R347), trans-1,2-dichloroethylene (tDCE) and ethanol (EtOH), wherein the content of (R347) is from 39.0 to 59.0%, the content of (tDCE) is from 37.5 to 59.5% and the content of (EtOH) is from 1.5 to 3.5%, to the total amount of (R347), (tDCE) and (EtOH) (hereinafter referred to as composition C).

The present invention provides a solvent composition comprising 1,1,2,2-tetrafluoroethyl-2,2,2-trifluoroethyl ether (R347), trans-1,2-dichloroethylene (tDCE) and 2-propanol (IPA), wherein the content of (R347) is from 40.0 to 60.0%, the content of (tDCE) is from 39.0% to 59.9% and the content of (IPA) is from 0.1 to 1.0%, to the total amount of (R347), (tDCE) and (IPA) (hereinafter referred to as composition D).

The present invention provides a solvent composition comprising 1,1,2,2-tetrafluoroethyl-2,2,2-trifluoroethyl ether (R347), trans-1,2-dichloroethylene (tDCE) and methanol (MeOH), wherein the content of (R347) is 44.9%, the content of (tDCE) is 50.0% and the content of (MeOH) is 5.1%, to the total amount of (R347), (tDCE) and (MeOH) (hereinafter referred to as composition E).

The present invention provides a solvent composition comprising 1,1,2,2-tetrafluoroethyl-2,2,2-trifluoroethyl ether (R347), trans-1,2-dichloroethylene (tDCE) and ethanol (EtOH), wherein the content of (R347) is 49.0%, the content of (tDCE) is 48.5% and the content of (EtOH) is 2.5%, to the total amount of (R347), (tDCE) and (EtOH) (hereinafter referred to as composition F).

The present invention provides a solvent composition comprising 1,1,2,2-tetrafluoroethyl-2,2,2-trifluoroethyl ether (R347), trans-1,2-dichloroethylene and 2-propanol (IPA), wherein the content of (R347) is 49.7%, the content of (tDCE) is 50.0% and the content of (IPA) is 0.3%, to the total amount of (R347), (tDCE) and (IPA) (hereinafter referred to as composition G).

The solvent compositions of the present invention contain a prescribed amount of a $C_{1-3}$ alcohol, and thus show an excellent cleaning performance in defluxing, particularly in removal of ionic soil.

BEST MODE FOR CARRYING OUT THE INVENTION

Composition A has a flash point higher than room temperature (25° C.), or has a nonflammable composition which does not ignite even at a boiling point. Further, composition A has a high solvency to oils and greases or fluxes.

As the $C_{1-3}$ alcohol in composition A, methanol, ethanol, 1-propanol or 2-propanol may, for example, be mentioned.

As composition A, particularly preferred is a solvent composition comprising from 30.0 to 65.0% (by mass) of 1,1,2,2-tetrafluoroethyl-2,2,2-trifluoroethyl ether, from 25.0 to 69.9% (by mass) of trans-1,2-dichloroethylene and from 0.1 to 10.0% (by mass) of a $C_{1-3}$ alcohol, to the total amount of the 1,1,2,2-tetrafluoroethyl-2,2,2-trifluoroethyl ether, the trans-1,2-dichloroethylene and the $C_{1-3}$ alcohol.

Compositions E, F and G are azeotropic solvent compositions. An azeotropic solvent composition is a composition which undergoes no compositional change even if it is vaporized and condensed repeatedly.

Further, compositions B, C and D are compositions which undergo little compositional change even if they are vaporized and condensed repeatedly and which thus can be employed practically in the same manner as an azeotropic solvent composition. Such a composition is generally called as an azeotrope-like solvent composition.

In a case where composition B, C, D, E, F or G is used for cleaning of articles, the compositional change is either little or none, and thus, it can be used while maintaining the stable cleaning performance. Further, cleaning can be carried out by employing the same equipment as used for R225 which has heretofore been employed, such being advantageous in that there is no need for substantially changing the conventional technology.

Compositions A to G are preferably constituted solely by 1,1,2,2-tetrafluoroethyl-2,2,2-trifluoroethyl ether, trans-1,2-dichloroethylene and a $C_{1-3}$ alcohol (in compositions B to G, a specific alcohol as specified above), but they may contain other compounds. Here, in the case of compositions B, C and D, they may, respectively, contain other compounds within a range where the nature of the azeotrope-like solvent compositions can be substantially maintained, and in the case of compositions E, F and G, they may, respectively, contain other compounds within a range where the nature of the azeotropic solvent composition can be substantially maintained.

As such other compounds, at least one compound selected from the group consisting of hydrocarbons, alcohols (except a $C_{1-3}$ alcohol), ketones, halogenated hydrocarbons (except trans-1,2-dichloroethylene), ethers, esters and glycol ethers, may be mentioned. The content of such compounds in the solvent composition is preferably at most 20 mass %, more preferably at most 10 mass %. The lower limit of the content of other compounds is the minimum amount where the purpose of adding the compounds can be attained. Usually, the minimum amount is at least 0.1 mass % to the total amount of the solvent composition. In a case where the solvent composition containing other compounds may have an azeotropic composition, it is preferred to use one having such an azeotropic composition.

As the hydrocarbons, $C_{5-15}$ linear or cyclic, saturated or unsaturated hydrocarbons are preferred, and n-pentane, 2-methylbutane, n-hexane, 2-methylpentane, 2,2-dimethylbutane, 2,3-dimethylbutane, n-heptane, 2-methylhexane, 3-methylhexane, 2,4-dimethylpentane, n-octane, 2-methylheptane, 3-methylheptane, 4-methylheptane, 2,2-dimethylhexane, 2,5-dimethylhexane, 3,3-dimethylhexane, 2-methyl-3-ethylpentane, 3-methyl-3-ethylpentane, 2,3,3-trimethylpentane, 2,3,4-trimethylpentane, 2,2,3-trimethylpentane, 2-methylheptane, 2,2,4-trimethylpentane, n-nonane, 2,2,5-trimethylhexane, n-decane, n-dodecane, cyclopentane, methylcyclopentane, cyclohexane, methylcyclohexane, ethylcyclohexane, bicyclohexane, decalin, tetralin or amyl naphthalene may, for example, be mentioned. More preferred is a $C_{5-7}$ hydrocarbon such as n-pentane, cyclopentane, n-hexane, cyclohexane or n-heptane.

As the alcohols, $C_{4-16}$ linear or cyclic, saturated or unsaturated alcohols are preferred, and n-butyl alcohol, sec-butyl alcohol, isobutyl alcohol, tert-butyl alcohol, 1-pentanol, 2-pentanol, 1-ethyl-1-propanol, 2-methyl-1-butanol, 3-methyl-1-butanol, 3-methyl-2-butanol, neopentyl alcohol, 1-hexanol, 2-methyl-1-pentanol, 4-methyl-2-pentanol, 2-ethyl-1-butanol, 1-heptanol, 2-heptanol, 3-heptanol, 1-octanol, 2-octanol, 2-ethyl-1-hexanol, 1-nonanol, 3,5,5-trimethyl-1-hexanol, 1-decanol, 1-undecanol, 1-dodecanol, cyclohexanol, 1-methylcyclohexanol, 2-methylcyclohexanol, 3-methylcyclohexanol, 4-methylcyclohexanol, α-terpineol, 2,6-dimethyl-4-heptanol, nonyl alcohol or tetradecyl alcohol may, for example, be mentioned. More preferred is a $C_{4-5}$ alkanol such as n-butyl alcohol.

As the ketones, $C_{3-9}$ linear or cyclic ketones are preferred. Specifically, acetone, methyl ethyl ketone, 2-pentanone, 3-pentanone, 2-hexanone, methyl isobutyl ketone, 2-heptanone, 3-heptanone, 4-heptanone, diisobutyl ketone, mesityl oxide, phorone, 2-octanone, cyclohexanone, methylcyclohexanone, isophorone, 2,4-pentanedione or 2,5-hexanedione may, for example, be mentioned. More preferred is a $C_{3-4}$ ketone such as acetone or methyl ethyl ketone.

As the halogenated hydrocarbons, $C_{1-6}$ chlorinated or chlorofluorinated hydrocarbons are preferred, and methylene chloride, 1,1-dichloroethane, 1,2-dichloroethane, 1,1,2-trichloroethane, 1,1,1,2-tetrachloroethane, 1,1,2,2-tetrachloroethane, pentachloroethane, 1,1-dichloroethylene, cis-1,2-dichloroethylene, trichloroethylene, tetrachloroethylene, 1,2-dichloropropane, dichloropentafluoropropane, dichlorofluoroethane or decafluoropentane may, for example, be mentioned. More preferred is a $C_{1-2}$ chlorinated hydrocarbon such as methylene chloride, trichloroethylene or tetrachloroethylene.

As the ethers, $C_{2-8}$ linear or cyclic ethers are preferred, and diethyl ether, dipropyl ether, diisopropyl ether, dibutyl ether, anisole, phenetole, methyl anisole, dioxane, furan, methylfuran or tetrahydrofuran may, for example, be mentioned. More preferred is a $C_{4-6}$ ether such as diethyl ether, diisopropyl ether, dioxane or tetrahydrofuran.

As the esters, $C_{2-19}$ linear or cyclic esters are preferred. Specifically, methyl formate, ethyl formate, propyl formate, butyl formate, isobutyl formate, pentyl formate, methyl acetate, ethyl acetate, propyl acetate, isopropyl acetate, butyl acetate, isobutyl acetate, sec-butyl acetate, pentyl acetate, methoxybutyl acetate, sec-hexyl acetate, 2-ethylbutyl acetate, 2-ethylhexyl acetate, cyclohexyl acetate, benzyl acetate, methyl propionate, ethyl propionate, butyl propionate, methyl butyrate, ethyl butyrate, butyl butyrate, isobutyl isobutyrate, ethyl 2-hydroxy-2-methyl propionate, methyl benzoate, ethyl benzoate, propyl benzoate, butyl benzoate, benzyl benzoate, γ-butyrolactone, diethyl oxalate, dibutyl oxalate, dipentyl oxalate, diethyl malonate, dimethyl maleate, diethyl maleate, dibutyl maleate, dibutyl tartrate, tributyl citrate, dibutyl sebacate, dimethyl phthalate, diethyl phthalate or dibutyl phthalate may, for example, be mentioned. More preferred is a $C_{3-4}$ ester such as methyl acetate or ethyl acetate.

The glycol ethers are compounds having a hydrogen atom of one or both of hydroxyl groups of a dimmer to tetramer of a $C_{2-4}$ dihydric alcohol, substituted by a $C_{1-6}$ alkyl group, and alkyl ethers of diethylene glycol and alkyl ethers of dipropylene glycol, are preferred. Specifically, a diethylene glycol ether such as diethylene glycol monomethyl ether, diethylene glycol monoethyl ether, diethylene glycol mononormalpropyl ether, diethylene glycol monoisopropyl ether, diethylene glycol mononormalbutyl ether, diethylene glycol monoisobutyl ether, diethylene glycol dimethyl ether, diethylene glycol diethyl ether or diethylene glycol dibutyl ether, a dipropylene glycol ether such as dipropylene glycol monomethyl ether, dipropylene glycol monoethyl ether, dipropylene glycol mononormalpropyl ether, dipropylene glycol monoisopropyl ether, dipropylene glycol mononormalbutyl ether or dipropylene glycol monoisobutyl ether, may be mentioned.

Further, primarily in order to increase the stability, one or more of the following compounds may, for example, be incorporated to compositions A to G within a range of from 0.001 to 5 mass %. In this regard, such compounds may be incorporated to composition B, C or D within a range where the nature of the azeotrope-like solvent composition can be substantially maintained, and the compounds may be incorporated to composition E, F or G within a range where the nature of the azeotropic solvent composition can be substantially maintained.

The compounds may, for example, be a nitro compound such as nitromethane, nitroethane, nitropropane or nitrobenzene; an amine such as diethylamine, triethylamine, isopropylamine or n-butylamine; a phenol such as phenol, o-cresol, m-cresol, p-cresol, thymol, p-t-butylphenol, t-butyl catechol, catechol, isoeugenol, o-methoxyphenol, bisphenol A, isoamyl salicylate, benzyl salicylate, methyl salicylate or 2,6-di-t-butyl-p-cresol; and a triazole such as 2-(2'-hydroxy-5'-methylphenyl)benzotriazole, 2-(2'-hydroxy-3'-t-butyl-5'-methylphenyl)-5-chlorobenzotriazole, 1,2,3-benzotriazole or 1-[(N,N-bis-2-ethylhexyl)aminomethyl]benzotriazole.

Compositions A to G may preferably be used for various applications in the same manner as conventional R-225 compositions. As a specific application, there may, for example, be an application as a cleaning agent for removing soil attached to articles, a carrier solvent for various compounds to be applied to articles, or an extractant. The material of the articles may, for example, be glass, ceramics, plastic, elastomer or metal. Further, specific examples of the articles may be electronic/electric instruments, precision machine instruments, optical instruments, or their components, such as ICs, micromotors, relays, bearings, optical lenses, printed boards or glass substrates.

The soil attached to such an article, may for example, be one which is used at the time of producing the article or a component of the article, and which has to be removed ultimately, or soil which attaches to the article during the use of the article. The material constituting such soil may, for example, be soils and greases, such as greases, mineral oils, waxes or oil-based inks, fluxes, or dust.

A specific method for removing the soil, may, for example, be manual cleaning, dip cleaning, spray cleaning, oscillating cleaning, ultrasonic cleaning or vapor cleaning. Further, a method having such methods combined, may be adopted.

The solvency for soil, etc., may be adjusted by changing the compositional ratio of composition A, B, C or D.

EXAMPLES

Now, Examples of the present invention and Comparative Examples will be described.

Examples 1 to 5, 7 to 11, 13 to 17, 19 to 23, 25 to 29, 31 to 35, 37 to 41, 43 to 47, 49 to 53, 55 to 67 and 69 to 72 are Examples of the present invention, and Examples 6, 12, 18, 24, 30, 36, 42, 48, 54 and 68 are Comparative Examples.

Further, the abbreviations used in each Table showing the test results have the following meanings.

R347: 1,1,2,2-tetrafluoroethyl-2,2,2-trifluoroethyl other tDCE: trans-1,2-dichloroethylene MeOH: methanol EtOH: ethanol IPA: 2-propanol

Examples 1 to 6

In accordance with the method described in ASTM D 92-90, the presence or absence of a flash point at 25° C., 40° C. or boiling point of the solvent composition was measured by means of a Cleveland open cup flash point tester by using the solvent composition having a composition as identified in Table 1. The results are shown in Table 1.

TABLE 1

| Example | R347 | tDCE | MeOH | Flash point at 25° C. | Flash point at 40° C. | Flash point at boiling point |
|---|---|---|---|---|---|---|
| 1 | 25.0 | 74.9 | 0.1 | Absent | Present | — |
| 2 | 35.0 | 61.0 | 4.0 | Absent | Absent | Absent |
| 3 | 44.9 | 50.0 | 5.1 | Absent | Absent | Absent |
| 4 | 55.0 | 39.0 | 6.0 | Absent | Absent | Absent |
| 5 | 75.0 | 15.0 | 10.0 | Absent | Absent | Absent |
| 6 | 20.0 | 79.9 | 0.1 | Present | — | — |

Examples 7 to 12

In accordance with the method described in ASTM D 92–90, the presence or absence of a flash point at 25° C., 40° C. or boiling point of the solvent composition was measured by means of a Cleveland open cup flash point tester by using the solvent composition having a composition as identified in Table 2. The results are shown in Table 2.

TABLE 2

| Example | R347 | tDCE | EtOH | Flash point at 25° C. | Flash point at 40° C. | Flash point at boiling point |
|---|---|---|---|---|---|---|
| 7 | 25.0 | 74.9 | 0.1 | Absent | Present | — |
| 8 | 39.0 | 59.5 | 1.5 | Absent | Absent | Absent |
| 9 | 49.0 | 48.5 | 2.5 | Absent | Absent | Absent |
| 10 | 59.0 | 37.5 | 3.5 | Absent | Absent | Absent |
| 11 | 75.0 | 15.0 | 10.0 | Absent | Absent | Absent |
| 12 | 20.0 | 79.9 | 0.1 | Present | — | — |

Examples 13 to 18

In accordance with the method described in ASTM D 92 to 90, the presence or absence of a flash point at 25° C., is 40° C. or boiling point of the solvent composition was measured by means of a Cleveland open cup flash point tester by using the solvent composition having a composition as identified in Table 3. The results are shown in Table 3.

TABLE 3

| Example | R347 | tDCE | IPA | Flash point at 25° C. | Flash point at 40° C. | Flash point at boiling point |
|---|---|---|---|---|---|---|
| 13 | 25.0 | 74.9 | 0.1 | Absent | Present | — |
| 14 | 40.0 | 59.9 | 0.1 | Absent | Absent | Absent |
| 15 | 49.7 | 50.0 | 0.3 | Absent | Absent | Absent |
| 16 | 60.0 | 39.0 | 1.0 | Absent | Absent | Absent |
| 17 | 75.0 | 15.0 | 10.0 | Absent | Absent | Absent |
| 18 | 20.0 | 79.9 | 0.1 | Present | — | — |

Examples 19 to 24

A cleaning test for a metal processing oil was carried out by using the solvent composition having a composition as identified in Table 4. Namely, a test piece of SUS-304 (25 mm×30 mm×2 mm) was dipped in a metal processing oil: temper oil (manufactured by NIPPON GREASE Co., Ltd.) to have the metal processing oil deposited thereon. The test piece was taken out from the metal processing oil, and then dipped in the solvent composition which was kept at 40° C., and cleaned for five minutes with ultrasonic oscillation. Removal degree of the metal processing oil from the test piece after the cleaning was evaluated by visual observation. The results are shown in Table 4. In Table 4, ○, Δ and X indicate well-removed, slightly remained, and remained, respectively.

TABLE 4

| Examples | R347 | tDCE | MeOH | Oil removal degree |
|---|---|---|---|---|
| 19 | 25.0 | 74.9 | 0.1 | ○ |
| 20 | 35.0 | 61.0 | 4.0 | ○ |
| 21 | 44.9 | 50.0 | 5.1 | ○ |
| 22 | 55.0 | 39.0 | 6.0 | ○ |
| 23 | 75.0 | 15.0 | 10.0 | ○ |
| 24 | 80.0 | 19.9 | 0.1 | Δ |

Examples 25 to 30

The cleaning test for the metal processing oil was carried out in the same methods as in Examples 19 to 24 except that the solvent composition having a composition as identified in Table 5 was used. The results are shown in Table 5. In Table 5, ○, Δ and X indicate well-removed, slightly remained, and remained, respectively.

TABLE 5

| Examples | R347 | tDCE | EtOH | Oil removal degree |
|---|---|---|---|---|
| 25 | 25.0 | 74.9 | 0.1 | ○ |
| 26 | 39.0 | 59.5 | 1.5 | ○ |
| 27 | 49.0 | 48.5 | 2.5 | ○ |
| 28 | 59.0 | 37.5 | 3.5 | ○ |
| 29 | 75.0 | 15.0 | 10.0 | ○ |
| 30 | 80.0 | 19.9 | 0.1 | Δ |

Examples 31 to 36

The cleaning test for the metal processing oil was carried out in the same methods as in Examples 19 to 24 except that the solvent composition having a composition as identified in the Table 6 was employed. The results are shown in Table 6. In Table ○, Δ and X indicate well-removed, slightly remained, and remained, respectively.

TABLE 6

| Examples | R347 | tDCE | IPA | Oil removal degree |
|---|---|---|---|---|
| 31 | 25.0 | 74.9 | 0.1 | ○ |
| 32 | 40.0 | 59.9 | 0.1 | ○ |
| 33 | 49.7 | 50.0 | 0.3 | ○ |
| 34 | 60.0 | 39.0 | 1.0 | ○ |
| 35 | 75.0 | 15.0 | 10.0 | ○ |
| 36 | 20.0 | 79.9 | 0.1 | Δ |

Examples 37 to 42

A flux cleaning test was carried out by using the solvent composition having a composition as identified in Table 7. Namely, flux JS-64ND manufactured by Kabushiki Kaisha Hiroki, was applied to an IPC B-25 comb electrode substrate and dried for 10 minutes at 100° C., and then, it was dipped in a molten solder bath of 260° C. for 3 seconds for soldering. After being left to stand for 24 hours at room temperature, the comb electrode substrate was dipped for 5 minutes in the solvent composition as identified in Table 7, kept at 40° C., for cleaning, whereby removal degree of flux was evaluated by visual observation. The results are shown in Table 7. In Table 7, ○, Δ and X indicate well-removed, white residue slightly remained, and white residue substantially remained, respectively.

TABLE 7

| Examples | R347 | tDCE | MeOH | Remaining degree of white residue |
|---|---|---|---|---|
| 37 | 25.0 | 74.9 | 0.1 | ○ |
| 38 | 35.0 | 61.0 | 4.0 | ○ |
| 39 | 44.9 | 50.0 | 5.1 | ○ |
| 40 | 55.0 | 39.0 | 6.0 | ○ |
| 41 | 75.0 | 15.0 | 10.0 | ○ |
| 42 | 80.0 | 19.9 | 0.1 | X |

Examples 43 to 48

The flux cleaning test was carried out in the same methods as in Examples 37 to 42 except that the solvent composition having a composition as identified in Table 8 was used. The results are shown in Table 8. In Table 8, ○, Δ and X indicate well-removed, white residue slightly remained, and white residue substantially remained, respectively.

TABLE 8

| Examples | R347 | tDCE | EtOH | Remaining degree of white residue |
|---|---|---|---|---|
| 43 | 25.0 | 74.9 | 0.1 | ○ |
| 44 | 39.0 | 59.0 | 1.5 | ○ |
| 45 | 49.0 | 48.5 | 2.5 | ○ |
| 46 | 59.0 | 37.5 | 3.5 | ○ |
| 47 | 75.0 | 15.0 | 10.0 | ○ |
| 48 | 80.0 | 19.9 | 0.1 | Δ |

Examples 49 to 54

The flux cleaning test was carried out in the same methods as in Examples 37 to 42 except that the solvent composition having a composition as identified in Table 9 was employed. The results are shown in Table 9. In Table 9, ○, Δ and X indicate well-removed, white residue slightly remained, and white residue substantially remained, respectively.

TABLE 9

| Examples | R347 | tDCE | IPA | Remaining degree of white residue |
|---|---|---|---|---|
| 49 | 25.0 | 74.9 | 0.1 | ○ |
| 50 | 40.0 | 59.9 | 0.1 | ○ |
| 51 | 49.7 | 50.0 | 0.3 | ○ |
| 52 | 60.0 | 39.0 | 1.0 | ○ |

TABLE 9-continued

| Examples | R347 | tDCE | IPA | Remaining degree of white residue |
|---|---|---|---|---|
| 53 | 75.0 | 15.0 | 10.0 | ○ |
| 54 | 20.0 | 79.9 | 0.1 | X |

Examples 55 to 59

20 kg of the solvent composition as identified in Table 10 was put in an open cleaning machine of a small size single sump type, and the cleaning machine was operated for 6 hours per day for 3 days. The operation condition was set so that only the composition was charged to the cleaning sump, and the composition was heated, evaporated and condensed, and then led to a water separator, and recycled to the cleaning sump, whereby the operation condition was adjusted so that the recycled amount per 1 hour would be equivalent to the amount of the charged composition. Sampling was carried out from the water separator after 18 hours of operation, and the results of the gas chromatography analysis are shown in Table 10.

TABLE 10

| Examples | Compositional ratio before operation (by mass) R347/tDCE/MeOH | Compositional ratio after 18 hours operation (by mass) R347/tDCE/MeOH |
|---|---|---|
| 55 | 35.0/61.0/4.0 | 35.6/60.1/4.3 |
| 56 | 44.9/50.0/5.1 | 44.9/50.0/5.1 |
| 57 | 55.0/39.0/6.0 | 54.4/40.0/5.6 |
| 58 | 30.0/65.0/5.0 | 36.4/62.9/0.7 |
| 59 | 70.0/28.0/2.0 | 63.8/35.2/1.0 |

Examples 60 to 64

The operation test employing the cleaning machine was carried out in the same methods as in Examples 55 to 59 except that the solvent composition as identified in Table 11 was used. The results are shown in Table 11.

TABLE 11

| Examples | Compositional ratio before operation (by mass) R347/tDCE/EtOH | Compositional ratio after 18 hours operation (by mass) R347/tDCE/EtOH |
|---|---|---|
| 60 | 39.0/59.5/1.5 | 39.8/58.1/2.1 |
| 61 | 49.0/48.5/2.5 | 49.0/48.5/2.5 |
| 62 | 59.0/37.5/3.5 | 58.5/38.2/3.3 |
| 63 | 30.0/60.0/10.0 | 34.6/59.0/6.4 |
| 64 | 70.0/29.0/1.0 | 61.3/37.3/1.4 |

Examples 65 to 69

The operation test employing the cleaning machine was carried out in the same methods as in Examples 55 to 59 except that the solvent composition as identified in Table 12 was employed. The results are shown in Table 12.

TABLE 12

| Examples | Compositional ratio before operation (by mass) R347/tDCE/IPA | Compositional ratio after 18 hours operation (by mass) R347/tDCE/IPA |
|---|---|---|
| 65 | 40.0/59.9/0.1 | 40.4/59.4/0.2 |
| 66 | 49.7/50.0/0.3 | 49.7/50.0/0.3 |
| 67 | 60.0/39.0/1.0 | 59.4/40.0/0.6 |
| 68 | 20.0/70.0/10.0 | 28.3/64.5/7.2 |
| 69 | 65.0/33.0/2.0 | 58.7/38.0/3.3 |

Example 70

300 g of a composition of 347/tDCE/MeOH=44.9 mass %/50.0 mass %/5.1 mass % was put in an Othmer vapor-liquid equilibrium apparatus, and at the time when the temperatures of the gas phase and the liquid phase became equilibrium under 1010 hPa, samples of the composition were collected from the gas phase and the liquid phase, and then their compositional ratios were measured by gas chromatography. The results are shown in Table 13.

TABLE 13

| Examples | Gas phase compositional ratio (by mass) R5213/tDE/MeOH | Liquid phase compositional ratio (by mass) R5213/tDE/MeOH |
|---|---|---|
| Before distillation | 44.9/50.0/5.1 | 44.9/50.0/5.1 |
| After equilibrium | 44.9/50.0/5.1 | 44.9/50.0/5.1 |

Example 71

300 g of a composition of 347/tDCE/EtOH=49.0 mass %/48.5 mass %/2.5 mass % was put in an Othmer vapor-liquid equilibrium apparatus, and at the time when the temperatures of the gas phase and the liquid phase became equilibrium under 1010 hPa, samples of the composition were collected from the gas phase and the liquid phase, and then their compositional ratios were measured by gas chromatography. The results are shown in Table 14.

TABLE 14

| Examples | Gas phase compositional ratio (by mass) R5213/tDE/MeOH | Liquid phase compositional ratio (by mass) R5213/tDE/MeOH |
|---|---|---|
| Before distillation | 49.0/48.5/2.5 | 49.0/48.5/2.5 |
| After equilibrium | 49.0/48.5/2.5 | 49.0/48.5/2.5 |

EXAMPLE-72

300 g of a composition of 347/tDCE/IPA=49.7 mass %/50.0 mass %/0.3 mass % was put in an Othmer vapor-liquid equilibrium still, and at the time when the temperatures of the gas phase and the liquid phase became equilibrium under 1010 hPa, samples of the composition were collected from the gas phase and the liquid phase, and then their compositional ratios were measured by gas chromatography. The results are shown in Table 15.

TABLE 15

| Examples | Gas phase compositional ratio (by mass) R5213/tDE/IPA | Liquid phase compositional ratio (by mass) R5213/tDE/IPA |
|---|---|---|
| Before distillation | 49.7/50.0/0.3 | 49.7/50.0/0.3 |
| After equilibrium | 49.7/50.0/0.3 | 49.7/50.0/0.3 |

The solvent compositions (compositions A to G) of the present invention have a high solvency against various soils and a flash point higher than room temperature. Further, compositions B, C and D are azeotrope-like solvent compositions, and compositions E, F and G are azeotropic solvent compositions. Therefore, these compositions undergo either little or no change in their compositions even if they are recycled for vapor cleaning or distillation, and their cleaning properties and various physical properties do not change. Therefore, a conventional cleaning machine can be used without substantial change.

INDUSTRIAL APPLICABILITY

The solvent composition of the present invention can remove oils and greases attached to articles such as electronic components, precision mechanical components or glass substrates, or soil such as flux or dust on printed boards, etc., with a high cleaning performance.

The entire disclosure of Japanese Patent Application No. 2002-194888 filed on Jul. 3, 2002 including specification, claims and summary is incorporated herein by reference in its entirety.

What is claimed is:

1. A solvent composition comprising 1,1,2,2-tetrafluoroethyl-2,2,2-trifluoroethyl ether (R347), trans-1,2-dichloroethylene (tDCE) and a $C_{1-3}$ alcohol (ROH), wherein the content of (R347) is from 25.0 to 75.0% by mass, the content of (tDCE) is from 15.0 to 74.9% by mass and the content of (ROH) is from 0.1 to 10.0% by mass, to the total amount of (R347), (tDCE) and (ROH).

2. A method of removing oil, grease, or both from an article, comprising contacting the article with the solvent composition of claim 1 to remove oil, grease or both from the article.

3. A solvent composition comprising 1,1,2,2-tetrafluoroethyl-2,2,2-trifluoroethyl ether (R347), trans-1,2-dichloroethylene (tDCE) and methanol (MeOH), wherein the content of (R347) is from 35.0 to 55.0% by mass, the content of (tDCE) is from 39.0 to 61.0% by mass and the content of (MeOH) is from 4.0 to 6.0% by mass, to the total amount of (R347), (tDCE) and (MeOH).

4. A method of removing oil, grease, or both from an article, comprising contacting the article with the solvent composition of claim 2 to remove oil, grease or both from the article.

5. A solvent composition comprising 1,1,2,2-tetrafluoroethyl-2,2,2-trifluoroethyl ether (R347), trans-1,2-dichloroethylene (tDCE) and ethanol (EtOH), wherein the content of (R347) is from 39.0 to 59.0% by mass, the content of (tDCE) is from 37.5 to 59.5% by mass and the content of (EtOH) is from 1.5 to 3.5% by mass, to the total amount of (R347), (tDCE) and (EtOH).

6. A method of removing oil, grease, or both from an article, comprising contacting the article with the solvent composition of claim 5 to remove oil, grease or both from the article.

7. A solvent composition comprising 1,1,2,2-tetrafluoroethyl-2,2,2-trifluoroethyl ether (R347), trans-1,2-dichloroethylene (tDCE) and 2-propanol (IPA), wherein the content of (R347) is from 40.0 to 60.0% by mass, the content of (tDCE) is from 39.0% to 59.9% by mass and the content of (IPA) is from 0.1 to 1.0% by mass, to the total amount of (R347), (tDCE) and (IPA).

8. A method of removing oil, grease, or both from an article, comprising contacting the article with the solvent composition of claim 7 to remove oil, grease or both from the article.

9. A solvent composition comprising 1,1,2,2-tetrafluoroethyl-2,2,2-trifluoroethyl ether (R347), trans-1,2-dichloroethylene (tDCE) and methanol (MeOH), wherein the content of (R347) is 44.9% by mass, the content of (tDCE) is 50.0% by mass and the content of (MeOH) is 5.1% by mass, to the total amount of (R347), (tDCE) and (MeOH).

10. A method of removing oil, grease, or both from an article, comprising contacting the article with the solvent composition of claim 9 to remove oil, grease or both from the article.

11. A solvent composition comprising 1,1,2,2-tetrafluoroethyl-2,2,2-trifluoroethyl ether (R347), trans-1,2-dichloroethylene (tDCE) and ethanol (EtOH), wherein the content of (R347) is 49.0% by mass, the content of (tDCE) is 48.5% by mass and the content of (EtOH) is 2.5% by mass, to the total amount of (R347), (tDCE) and (EtOH).

12. A method of removing oil, grease, or both from an article, comprising contacting the article with the solvent composition of claim 11 to remove oil, grease or both from the article.

13. A solvent composition comprising 1,1,2,2-tetrafluoroethyl-2,2,2-trifluoroethyl ether (R347), trans-1,2-dichloroethylene and 2-propanol (IPA), wherein the content of (R347) is 49.7% by mass, the content of (tDCE) is 50.0% by mass and the content of (IPA) is 0.3% by mass, to the total amount of (R347), (tDCE) and (IPA).

14. A method of removing oil, grease, or both from an article, comprising contacting the article with the solvent composition of claim 13 to remove oil, grease or both from the article.

* * * * *